US006358191B1

(12) United States Patent
Greever

(10) Patent No.: US 6,358,191 B1
(45) Date of Patent: Mar. 19, 2002

(54) SYSTEM AND METHOD FOR FLEXIBLE CONTROL AND ADJUSTMENT OF A BOX FORMING MACHINE

(75) Inventor: Mark R. Greever, Atlanta, GA (US)

(73) Assignee: The Mead Corporation, Smyrna, GA (US)

( * ) Notice: Subject to any disclaimer, the term of this patent is extended or adjusted under 35 U.S.C. 154(b) by 0 days.

(21) Appl. No.: 09/384,515

(22) Filed: Aug. 27, 1999

(51) Int. Cl.[7] ..... B31B 1/00

(52) U.S. Cl. ..... 493/34; 493/23; 493/25; 493/30; 493/19

(58) Field of Search ..... 493/34, 30, 25, 493/23, 22, 19, 14, 13, 10, 8, 7

(56) References Cited

U.S. PATENT DOCUMENTS 4,323,098 A * 4/1982 Suzuki et al. ..... 493/34
4,368,052 A * 1/1983 Bitsky et al. ..... 493/7
4,515,579 A 5/1985 Beckett
4,565,048 A * 1/1986 Lade ..... 493/34
4,604,083 A * 8/1986 Barny et al. ..... 493/34
4,724,429 A * 2/1988 Millen et al. ..... 493/34
4,821,203 A 4/1989 Carlton et al.
4,847,775 A 7/1989 Roch et al.
5,147,271 A 9/1992 Bacques et al.
5,160,307 A 11/1992 Bacques et al.
5,242,364 A * 9/1993 Lehmann ..... 493/34
5,372,569 A * 12/1994 Ballos ..... 493/34
5,735,785 A * 4/1998 Lucas et al. ..... 493/34
5,827,162 A * 10/1998 Rubin et al. ..... 493/34
5,971,905 A * 10/1999 Fukuda ..... 493/34
6,059,705 A * 5/2000 Ruthenberg et al. ..... 493/34

* cited by examiner

*Primary Examiner*—Peter Vo
*Assistant Examiner*—Sameh Tawfik
(74) *Attorney, Agent, or Firm*—Needle & Rosenberg, P.C.

(57) ABSTRACT

A control system and method for adjustable and flexible control of a box forming machine. The system comprises a controller that is programmable to control the operation of a plurality of machine elements of the box forming machine and an operator interface coupled to the programmable controller. The operator interface comprises a display screen and one or more buttons, or is a touch screen display, to permit user input and a display of information to the user that is generated by the controller. The controller is programmed to store information control information describing a plurality of operational parameters for the plurality of machine elements for each of a plurality of box types; receive a selection from the operator interface to select one of a plurality of box types; monitor a position of a box blank as it is moved through the box forming machine; and generate control signals to control the plurality of machine elements based on operational parameters for the selected box type so that the box forming machine forms one or more boxes of the selected box type.

45 Claims, 12 Drawing Sheets

SYSTEM AND METHOD FOR FLEXIBLE CONTROL AND ADJUSTMENT OF A BOX FORMING MACHINE

BACKGROUND OF THE INVENTION

The present invention is directed to box forming machines, and more particularly, to a control system and method for adjusting the operational parameters of machine elements in a box forming machine to electronically program the machine to produce a variety of box types, thereby eliminating most manual adjustments of machine elements.

Presently, box forming machines are used to form boxes from blanks of cardboard or other similar box material. Box forming machines currently available comprise a plurality of mechanical elements that are actuated under control of signals generated by a network of electrical relays. An example of such a box forming machine is the FCO 140 machine manufactured and sold by Otor of France. The operational parameters of the mechanical elements are controlled by the relays. The relay network, once designed and implemented, can control the machine with only one set of box parameters. If it is desired to add a new function or to use the same box forming machine to produce boxes with different parameters, that is, boxes having different shapes, dimensions, etc., it is necessary to manually re-configure the relay network and/or add new hardware. Manually re-configuring the relay network takes a significant amount of time, thereby creating "down" time for the machine. What is needed is a fast and easy way to adjust the operational parameters of the machine elements in the box forming machine so that a single box forming machine can produce multiple box types without the need to re-configure a relay network. It is even more desirable to provide user programmability for a box forming machine so that an unsophisticated user can select different box types at the touch of a button or issue of a command, and can adjust various settings of a box type in the same manner.

SUMMARY OF THE INVENTION

Briefly, the present invention is directed to a control system and method for a box forming machine. The control system features a controller that is programmable to control the operation of a plurality of machine elements of the box forming machine and an operator interface coupled to the programmable controller. The operator interface comprises a display screen and one or more buttons, or is a touch screen display. The operator interface permits user input and display of information to the user that is generated by the controller. The controller is programmed store control information describing a plurality of operational parameters for the plurality of machine elements for each of a plurality of box types; receive a selection from the operator interface to select one of a plurality of box types; monitor a position of a box blank as it is moved through the box forming machine; and generate control signals to control the plurality of machine elements based on operational parameters for the selected box type so that the box forming machine forms one or more boxes of the selected box type.

The above and other objects and advantages of the present invention will become more readily apparent when reference is made to the following description, taken in conjunction with the accompanying drawings.

DETAILED DESCRIPTION OF THE DRAWINGS

Figure 1:
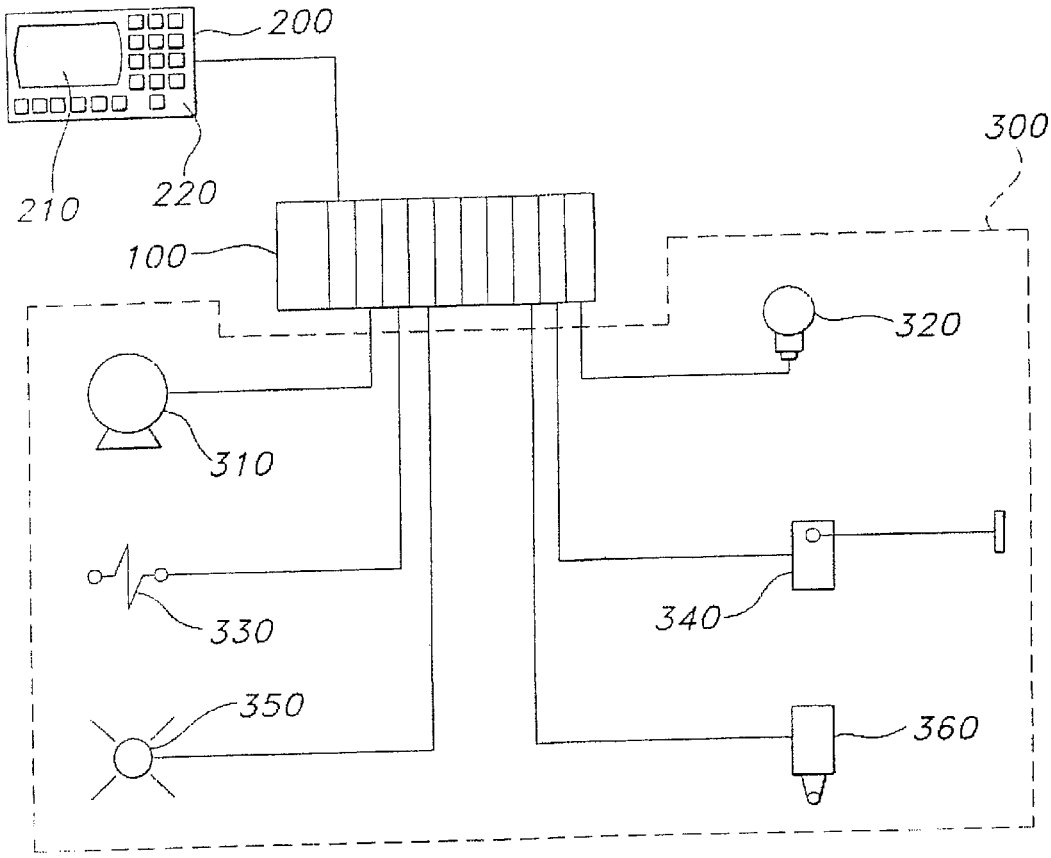
FIG. 1 is a block diagram of a control system for a box forming machine according to one embodiment of the present invention.

Referring first to FIG. 1, one embodiment of the control system according to the present invention is shown in conjunction with elements of a box forming machine. The control system in this embodiment comprises a programmable logic controller (PLC) 100 and an operator interface 200. The box forming machine is shown generally at reference numeral 300. The machine elements of the box forming machine 300 with which the control system interoperates include one or more motors 310, an encoder 320, one or more solenoid valves 330, one or more photoeyes (or photodetectors) 340, pilot lights 350 and limit switches 360.

The control system and method according to the present invention involves reading a signal output by the encoder 320 positioned in the forming machine 300. The encoder tracks the point in the operation cycle of the box forming machine for forming a box. Thus, the signal output by the encoder 320 represents a value between (0°–359°) which represents a current point in a cycle of operation of the box forming machine. The signal output by the encoder 320 is used by the control system to determine whether and when to generate a control signal to activate a machine element, or to determine whether a fault has occurred.

Figure 2:
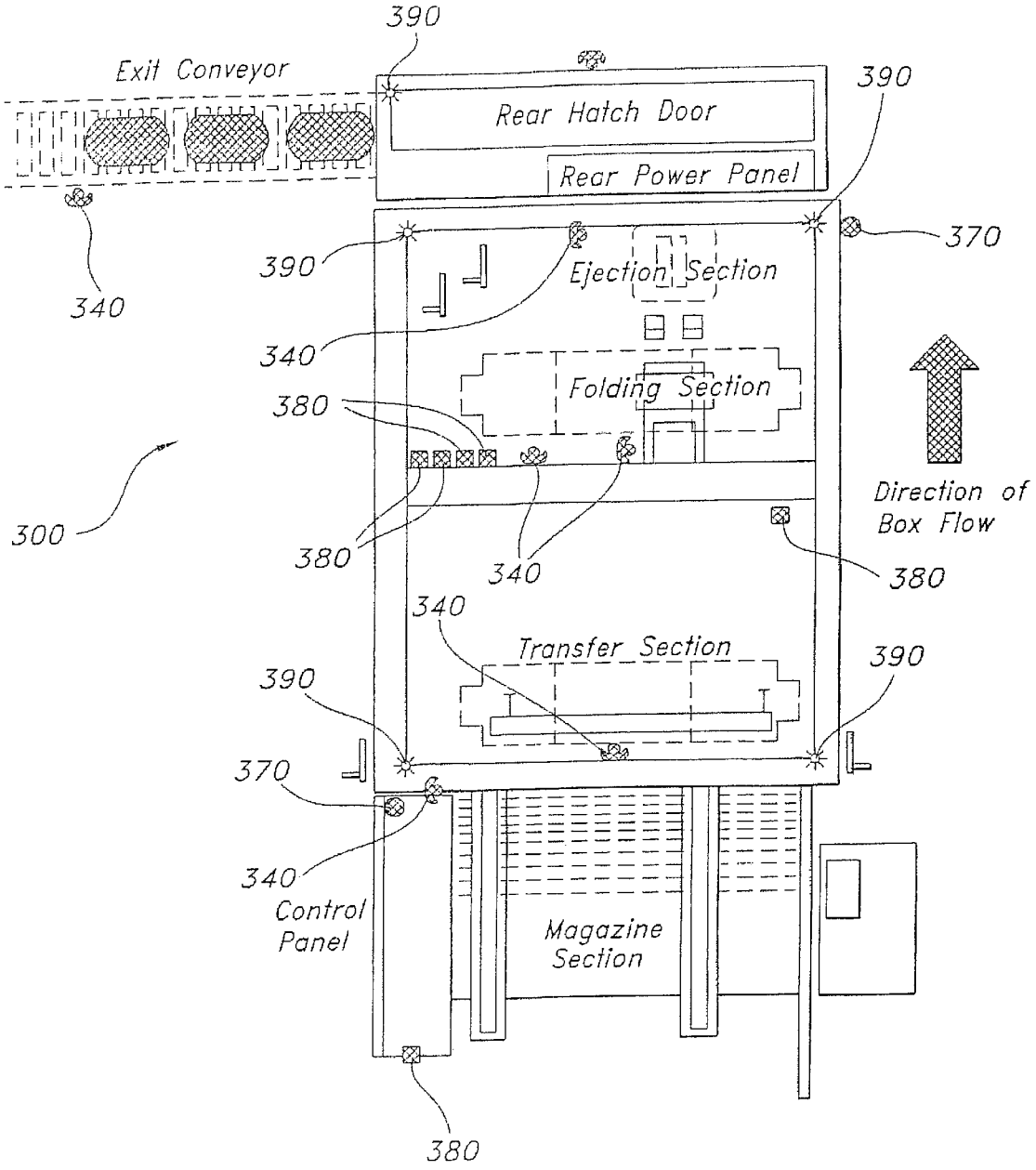
FIG. 2 is a diagram illustrating the various sections or stations of a box forming machine in which the control system of the present invention is useful.

FIG. 2 illustrates an example of a box forming machine 300 and in particular the flow path of a box blank therethrough, and the interaction of the various machine elements. The various sections or stations of the box forming machine 300 are labeled in the figure, and are self explanatory. Located within each section are one or more photoeyes 340 positioned to monitor a particular activity, such as presence of a box blank or position of a machine element. In addition, there are several emergency stop (E-stop) buttons 370 positioned at various locations in the box forming machine 300. The E-stop buttons cause the machine to immediately shut down. Adjusting motors 380 are also located at various positions in the machine to allow manual adjustment of certain machine functions. There are also door safety latches 390 that are located in various positions to ensure safe access to stations of the machine 300.

As one with ordinary skill in the art appreciates, the box forming machine 300 moves a cardboard blank through a series of mechanical elements located in the various sections shown in FIG. 2 to achieve the desired folds, application of glue, etc. The PLC 100 stores information (that is user adjustable or programmable) for the settings of the machine elements in order to form a box of a desired type. Moreover, the PLC 100 stores information for a plurality of box types. A user interfaces with the PLC 100 through the operator interface 200. The operator interface 200 includes a screen 210 and a button keypad 220. Information is displayed on the screen 210 under control of the PLC 100 to guide a user through a set up routine before initiating operation of the machine. The screen 210 may be a touch-screen display screen in which case a separate keypad may not be necessary.

FIGS. 3–7 show examples of various displays screens that are displayed in accordance with the system and method according to the present invention. All of these screens are displayed on a touch screen display device, but may be displayed on any type of display device suitable for use in a particular operating environment.

Figure 3:
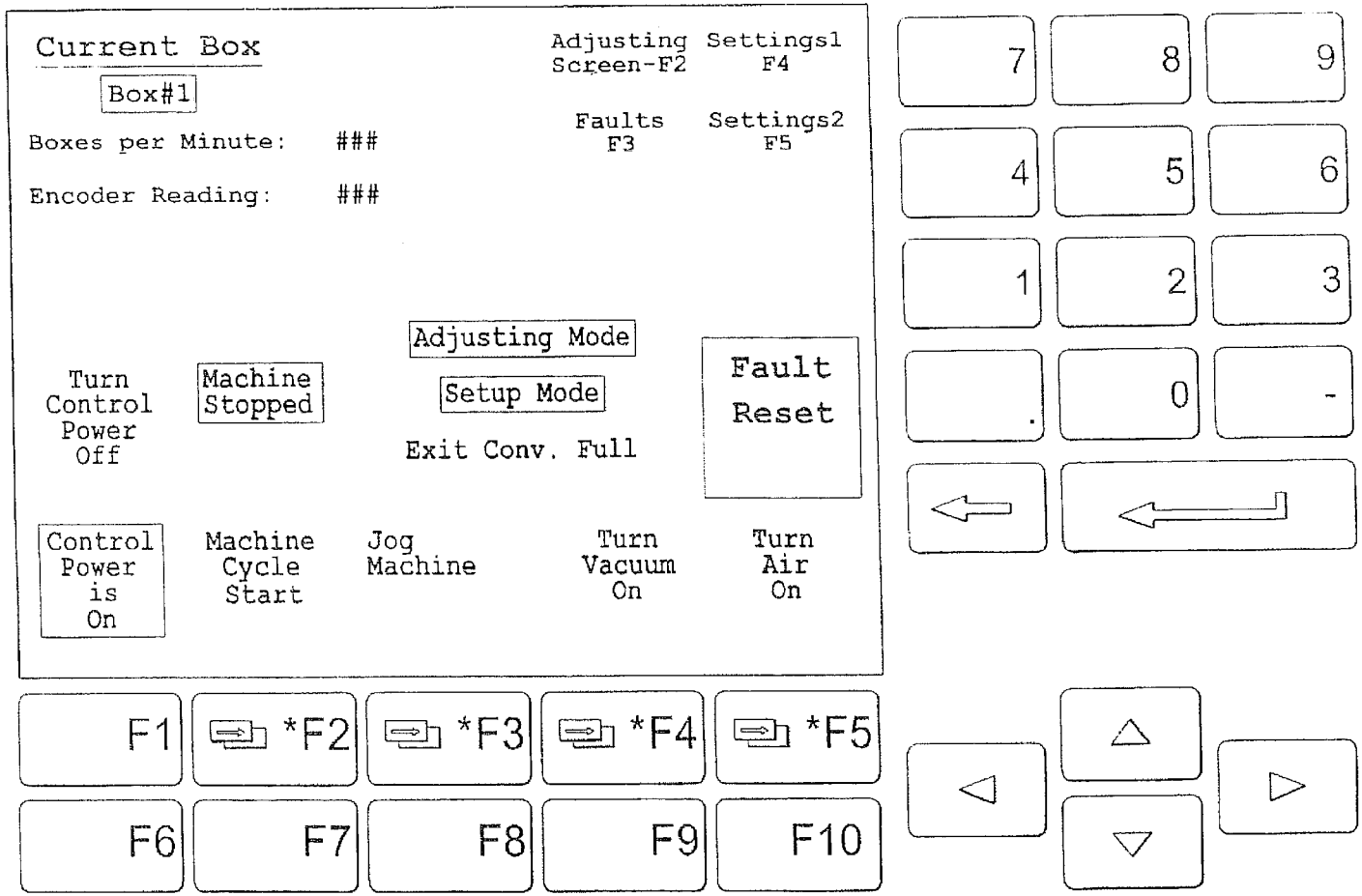
FIG. 3 is an example of a main display screen that is displayed to a user at an initial stage of operation.

FIG. 3 illustrates a main display screen from which a user can initiate adjusting of parameters and operation of the box forming machine. This display screen includes function buttons F1–F10 to go to other screens to initiate various functions. For example, function button F2 will jump to the adjusting mode display screen (FIG. 4), function button F3 will jump to the faults display screen (FIG. 7), function button F4 will jump to the settings1 screen (FIG. 5) and function button F5 will jump to the settings2 screen (FIG. 6). In addition, the main display screen displays status information of the operation of the machine, such as the number of boxes formed per minute, and the current encoder reading. Similarly, there are various icon/buttons that are labeled which can be activated when pressed by a user or which are highlighted in response to a detected machine condition, such as "Turn Control Power off"; "Machine Stopped"; "Fault Reset"; "Control Power is On"; "Machine Cycle Start"; "Job Machine"; "Turn Vacuum On"; and "Turn Air On".

Figure 4:
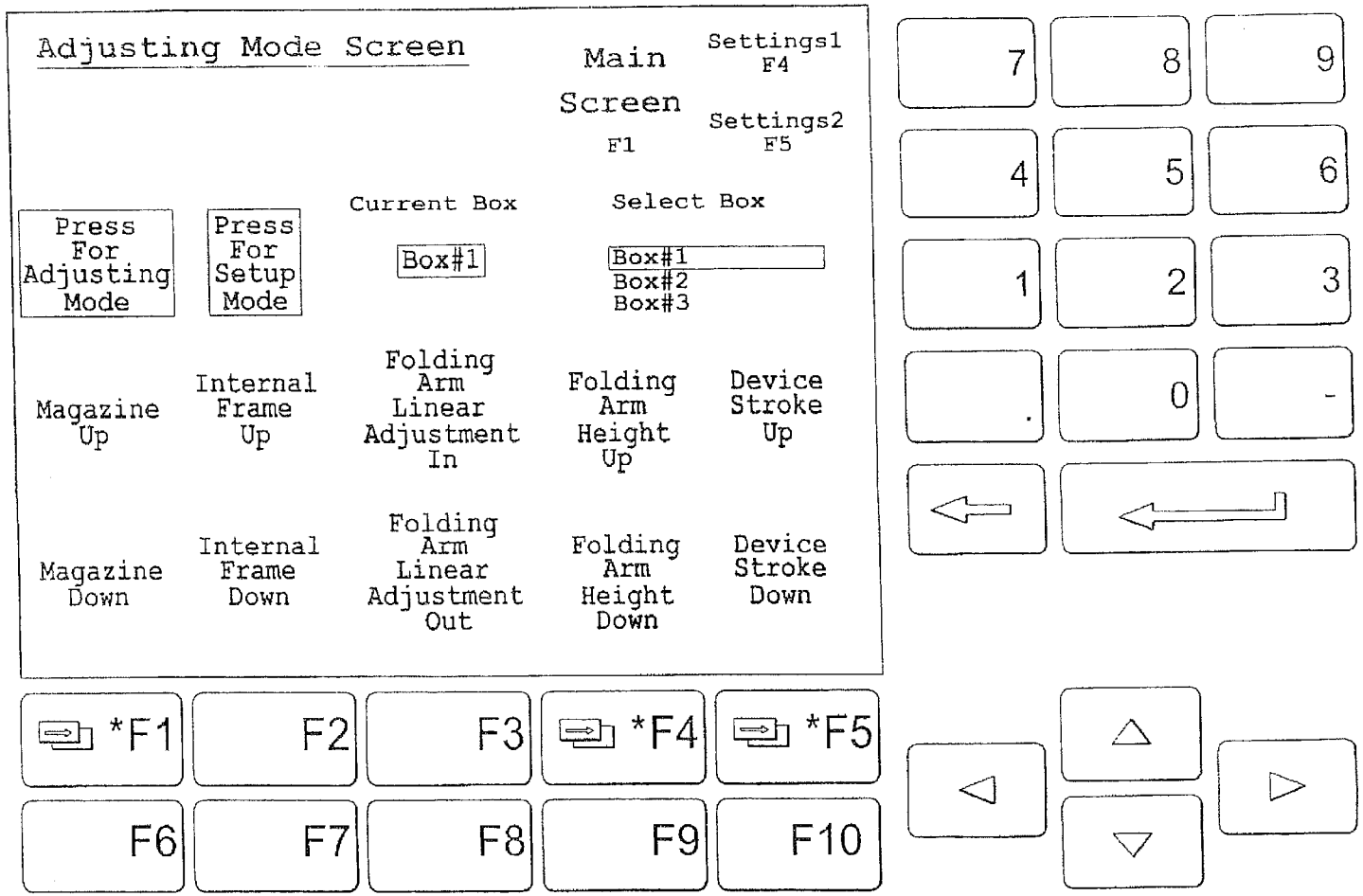
FIG. 4 is an example of an adjusting mode display screen that is displayed to a user to initiate adjustment of a box parameter for a box type.

The adjusting mode screen shown in FIG. 4 is the screen through which a user can adjust the mode of operation of the machine or adjust the setup of the machine, for any of a plurality of box types. Examples of the parameters that can be altered (for adjustment or setup) are shown as the labeled buttons on the adjusting mode screen. These are: "Magazine Up"; "Magazine Down"; "Internal Frame Up"; "Internal Frame Down"; "Folding Arm Linear Adjustment In"; "Folding Arm Linear Adjustment Out"; "Folding Arm Height Up"; "Folding Arm Height Down"; "Device Stroke Up"; "Device Stroke Down".

Figure 5:
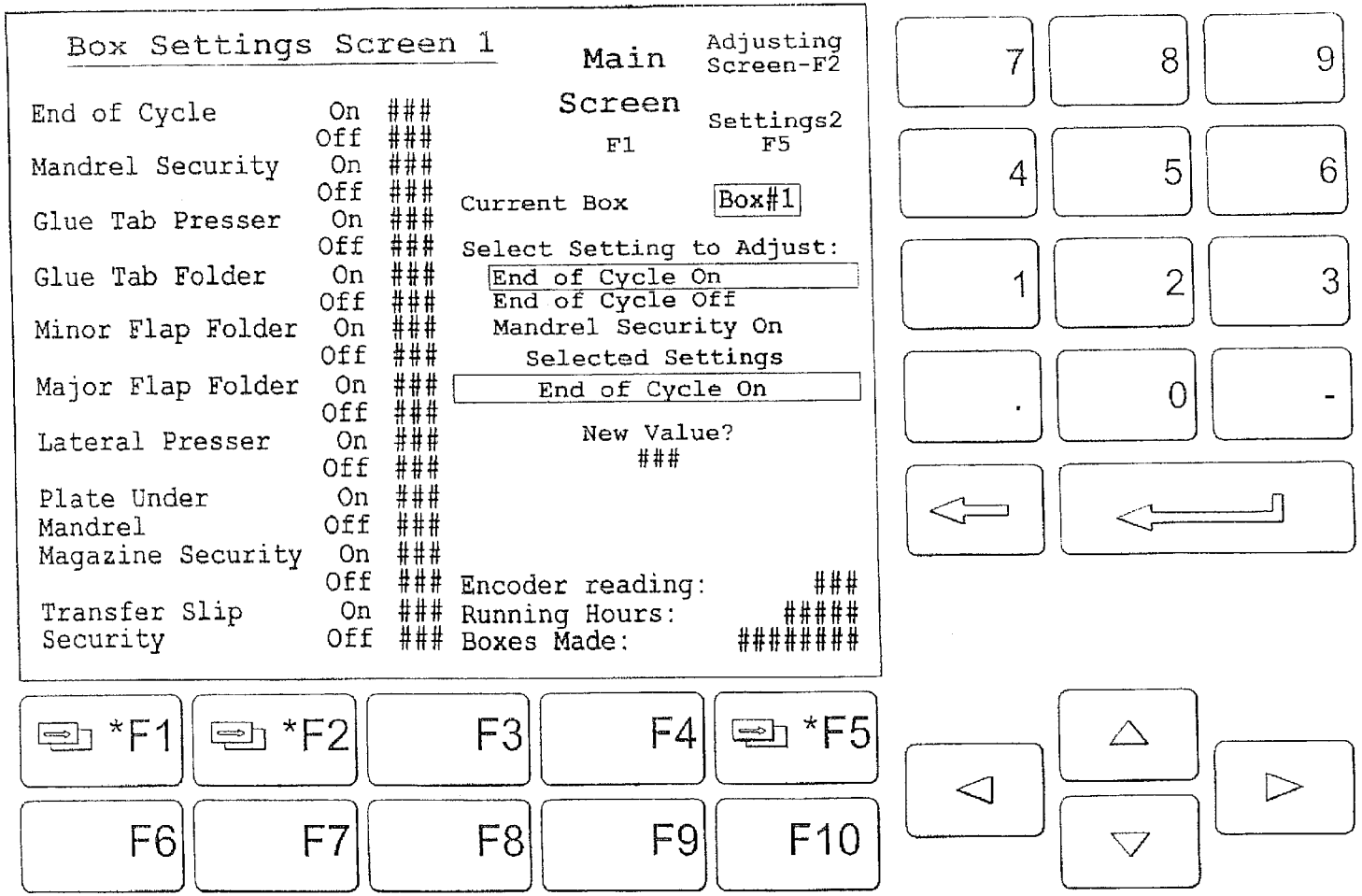
FIGS. 5 and 6 are examples of box settings display screens which are displayed to a user to allow adjustment of a box settings for a box type.
Figure 6:
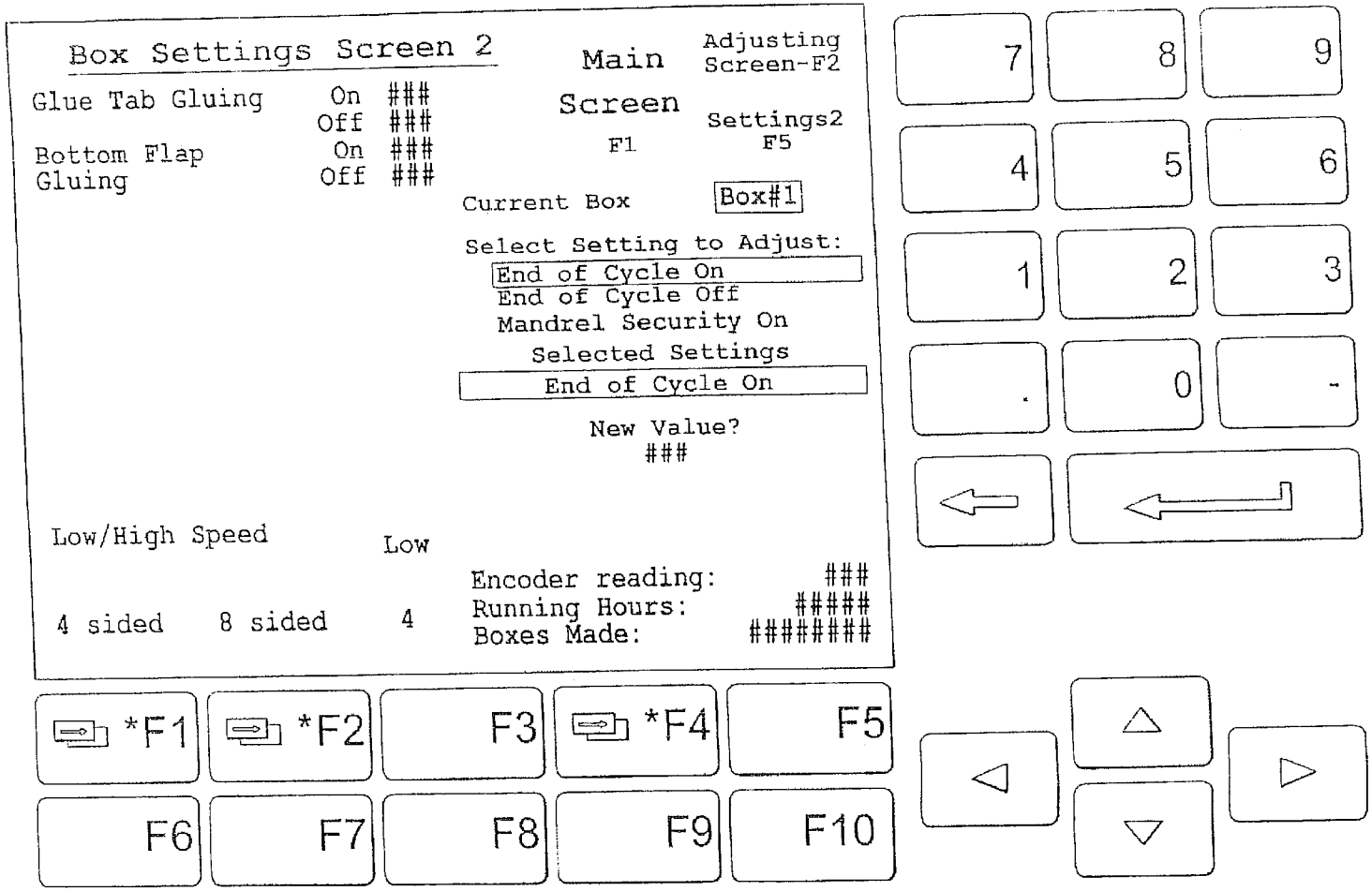

FIGS. 5 and 6 illustrate box settings screens. FIG. 5 displays buttons that allow a user to adjust parameters such as "End of Cycle"; "Mandrel Security"; "Glue Tab Presser"; "Glue Tab Folder"; "Minor Flap Folder"; "Major Flap Folder"; "Lateral Presser"; "Plate Under Mandrel"; "Magazine Security"; and "Transfer Slip Security". FIG. 6 displays buttons for the additional parameters "Glue Tab Gluing"; "Bottom Flap Gluing"; "Low/High Speed" and "4 Sided/8 Sided". For each of the parameters, a user may activate or de-activate it, and depending on the parameter selected, may adjust a value associated with it. For example, if "bottom flap gluing on" is to be altered, a user first selects that setting. Then, by choosing the option to change the value, one could enter a new degree value for "bottom flap gluing on."

Figure 7:
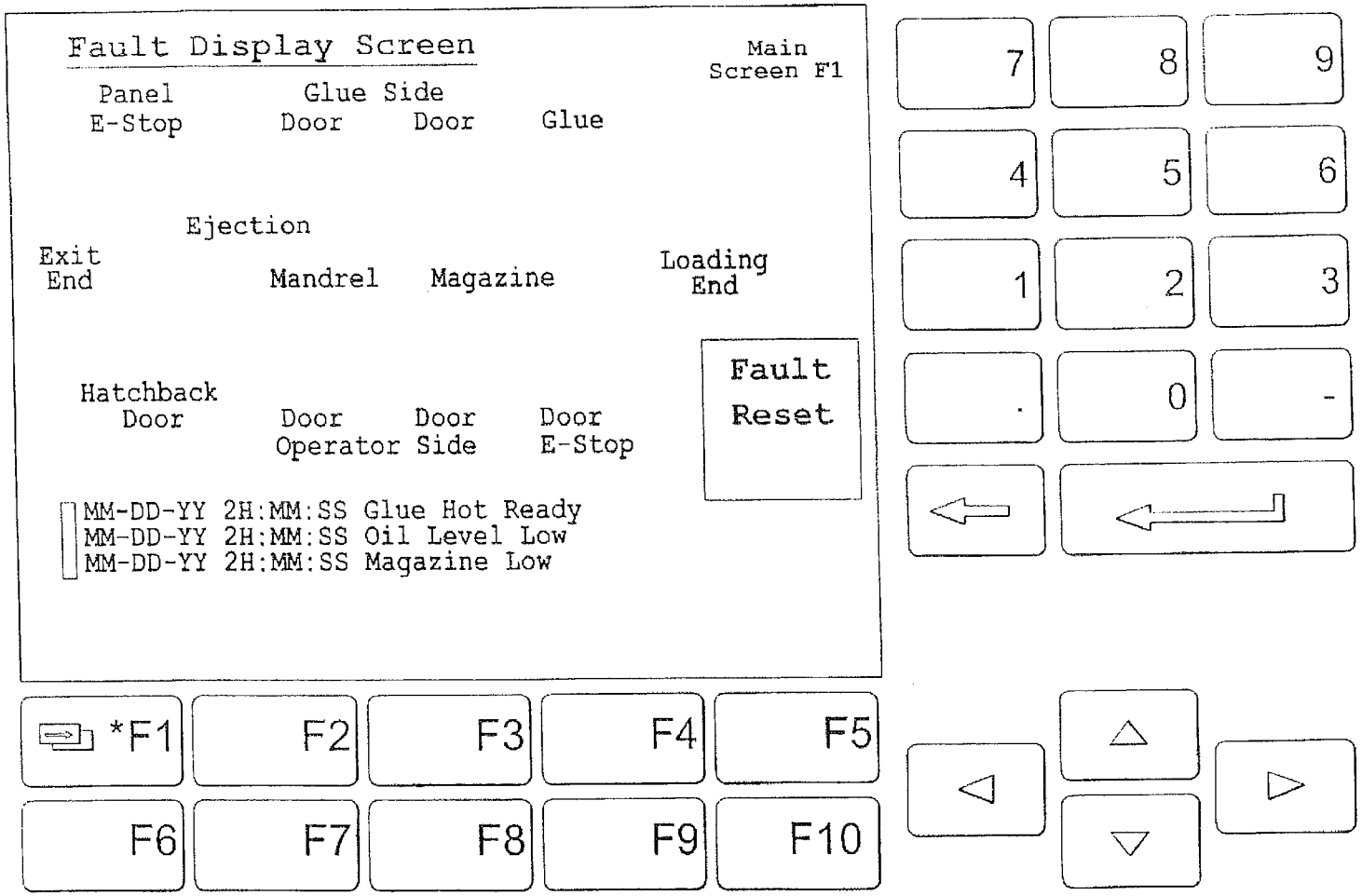
FIG. 7 is an example of a fault display screen that is displayed to a user when a fault in the operation of the box forming machine is detected.
Figure 8:
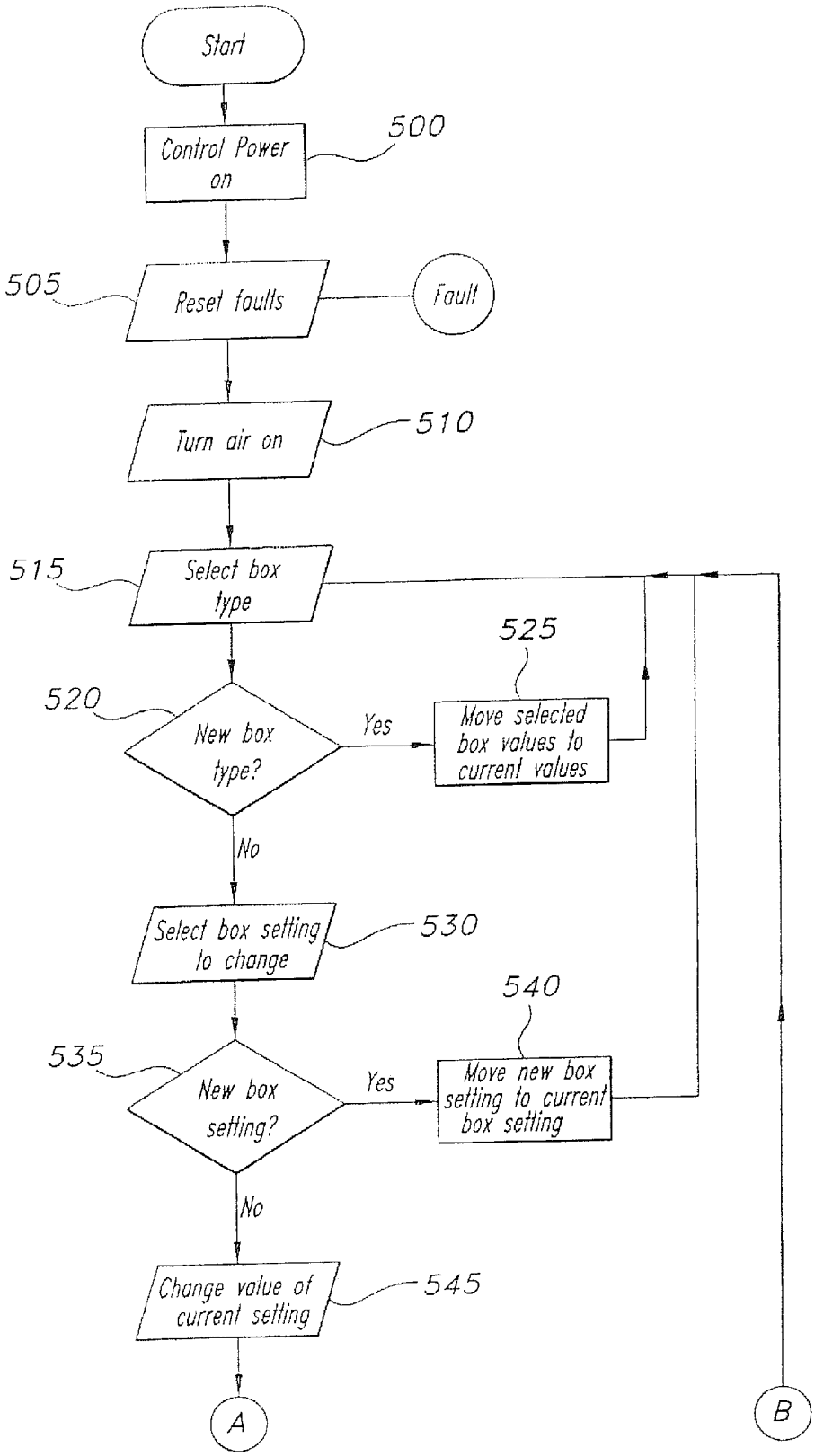
FIGS. 8–11 are diagrams of a flow chart depicting the programming and control procedure according to the present invention.

FIG. 7 illustrates a fault display screen, which displays a list of names of elements in the box forming machine that may be a source of an operation fault. Examples of such elements are "Panel E-Stop"; "Glue Side Exit End Door Open"; "Ejection Fault"; "Mandrel Security Fault"; Magazine Security Fault"; "Operator Side Loading End Door Open"; "Hatchback Door Open"; and "Operator E-Stop". Also, information is displayed to reflect whether a glue gun is not ready for operation, oil level in the machine is low and the blank magazine is low. A fault reset button is provided on the fault display screen to allow a user to reset operation of the machine.

During set up or adjustment of the box forming machine, operational parameters of the various machine elements involve timing of actuation, which is related or referenced to the current encoder value. Thus, the stored control information describing operational parameters is translated or converted to define an activation range of encoder values within which the various machine elements should be activated. In this manner, the stored control information will cause the generation of control signals at the appropriate time during the cycle of operation of the box forming machine to form a box of a particular box type.

Examples of the signals representing the position of a box blank in the machine include: a signal output by a photoeye that is positioned to determine when a box blank has been released from a magazine for processing by the machine, a signal output by a photoeye that is positioned to determine when a blank is in position for folding, a signal output by a photoeye that is positioned to determine when a box blank is in position to receive glue from the glue gun. Examples of the control signals that are generated based on encoder values are: a control signal to activate one or more air cylinders in the box forming machine that closes box flaps on the box when the signal output by the encoder is within an activation range determined by the operational parameters for the box type, and a control signal to cause activation of the glue gun when it is determined that a box blank is in position and the signal output from the encoder is within an activation range, again determined by the operational parameters for the box type.

Referring to FIGS. 8–11, a flow chart depicting the control method according to the present invention will be described. In step 500, power is turned on for the control system, and in response thereto, faults are reset in step 505. In step 510, air supply to the various air cylinders in the machine 300 is activated.

In step 515, a user selects a box type to be formed by the machine 300. In step 520, it is determined whether the box type is a new box type (one not currently in production). If a new box type is selected, then in step 525, the box settings stored in the memory locations for that box are moved to the memory locations for active box production. If a box type selected in step 515 is not a new box type, then in step 530, a user may select a box setting of the selected box type to be changed. In step 535, if the box setting to be changed is a new box setting, then in step 540, the new box setting becomes the active setting.

If the box setting selected in step 530 is not a new box setting for the current box type, then in step 545, the user may change the value of the selected box setting. For example, as the active box setting is changed, all settings inn the active box memory locations are copied to the permanent memory locations for that box type.

Figure 9:
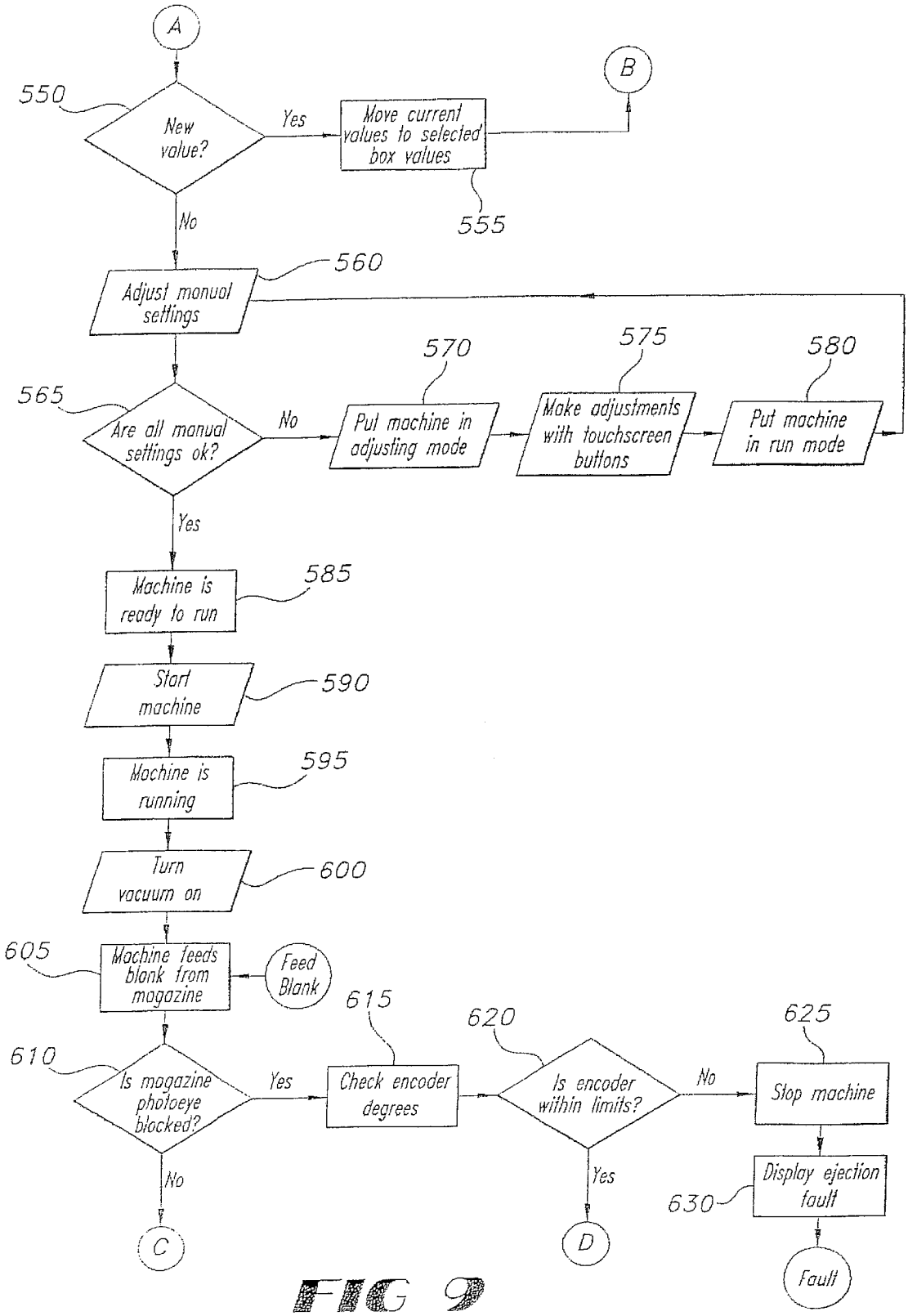

Turning to FIG. 9, in step 550, if the value to be changed for a selected box setting is a new value, then in step 555, the new value is stored as the current value for the selected box setting value. Otherwise, if a new value is not to be assigned for a box setting, then in step 560, a user may adjust manual settings. Examples of manual settings are those shown in FIG. 3: magazine roof height adjustment, internal frame height adjustment, folding arm travel adjustment, folding arm linear adjustment, and lifting frame stroke adjustment.

In step 565, it is determined whether all of the manual settings are valid. The operator visually determines if a setting is correct. If not, the operator uses the adjustment screen to bring the setting to a correct value. If one of the manual settings is not valid, then in step 570, the operator puts the machine in an adjusting mode. In the adjusting mode, the user may make adjustments in step 575 using touch screen buttons on the screen 210 of the operator interface 200. Once the user completes the adjustment mode, then in step 580, the machine is put in the run mode, and the process continues to step 560.

If in step 565 it is determined that all of the manual settings are valid, then the process proceeds to step 585, where the machine is put into a ready to run state. In step 590, the machine is started and step 595 represents the machine actually running. In step 600, vacuum to the feeder at the magazine is turned on. In step 605, the machine feeds the blank from the magazine that holds a batch of cardboard blanks. In step 610, a signal from a photoeye associated with the magazine is monitored to determine whether the photoeye is blocked. The magazine photoeye is positioned to be blocked when there is a feeding problem or failure. If it is determined in step 610 that the magazine photoeye is blocked, then in step 615, the encoder degrees is checked. The PLC 100 reads a signal output from the encoder indicating a degree value (0°–359°). In step 620, the PLC 100 then checks to see if the reading is currently in an activation range for a specific function. For example, the minor flap cylinder should be fired between 240° and 250°. If the reading falls in the range, the function is performed, otherwise, it is not performed, and a fault may be generated.

Figure 10:
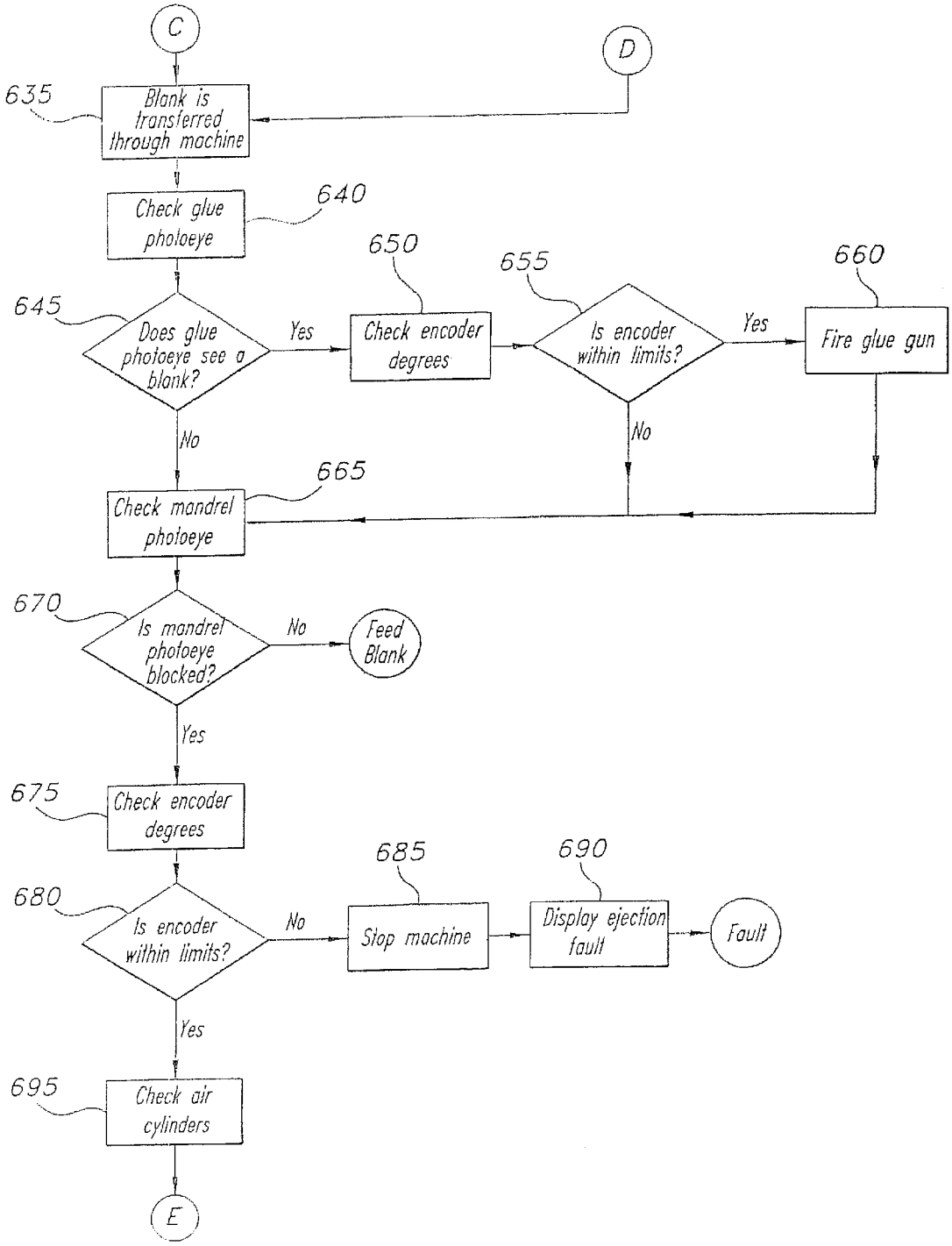

With reference to FIG. 10, in step 635, the cardboard blank is transferred further through the machine to, for example, a glue station. In step 640, the output signal from a glue photoeye is monitored, and if in step 645, it is determined that the output signal from the glue photoeye indicates that a blank is present in position for the glue gun, the signal output by the encoder is checked in step 650. If the encoder degree value is within an activation range corresponding to the programmed parameters in step 655, then in step 660, a signal is generated that is coupled to the glue gun to cause the glue gun to fire and apply glue to the blank. If in step 655, it is determined that the encoder degrees is not within the activation range for causing activation of the glue gun, then the process continues to step 665, bypassing step 660.

In step 665, the output signal from a photoeye positioned to monitor the mandrel is examined. The mandrel photoeye detects that a blank is present under the mandrel. If the output signal from the mandrel photoeye indicates that it is blocked, then the process continues to step 670. Otherwise, the process restarts from step 605 (FIG. 9).

In step 675, the signal output by the encoder s checked again. If it is determined in step 680 that the encoder degree value is within an activation range corresponding to the programmed parameters, then the process continues. Otherwise, a signal is generated to stop the machine in step 685, and in step 690 a message or other indicator is displayed indicating an ejection fault. In step 695, a signal is monitored representing the status of the air cylinders.

Figure 11:
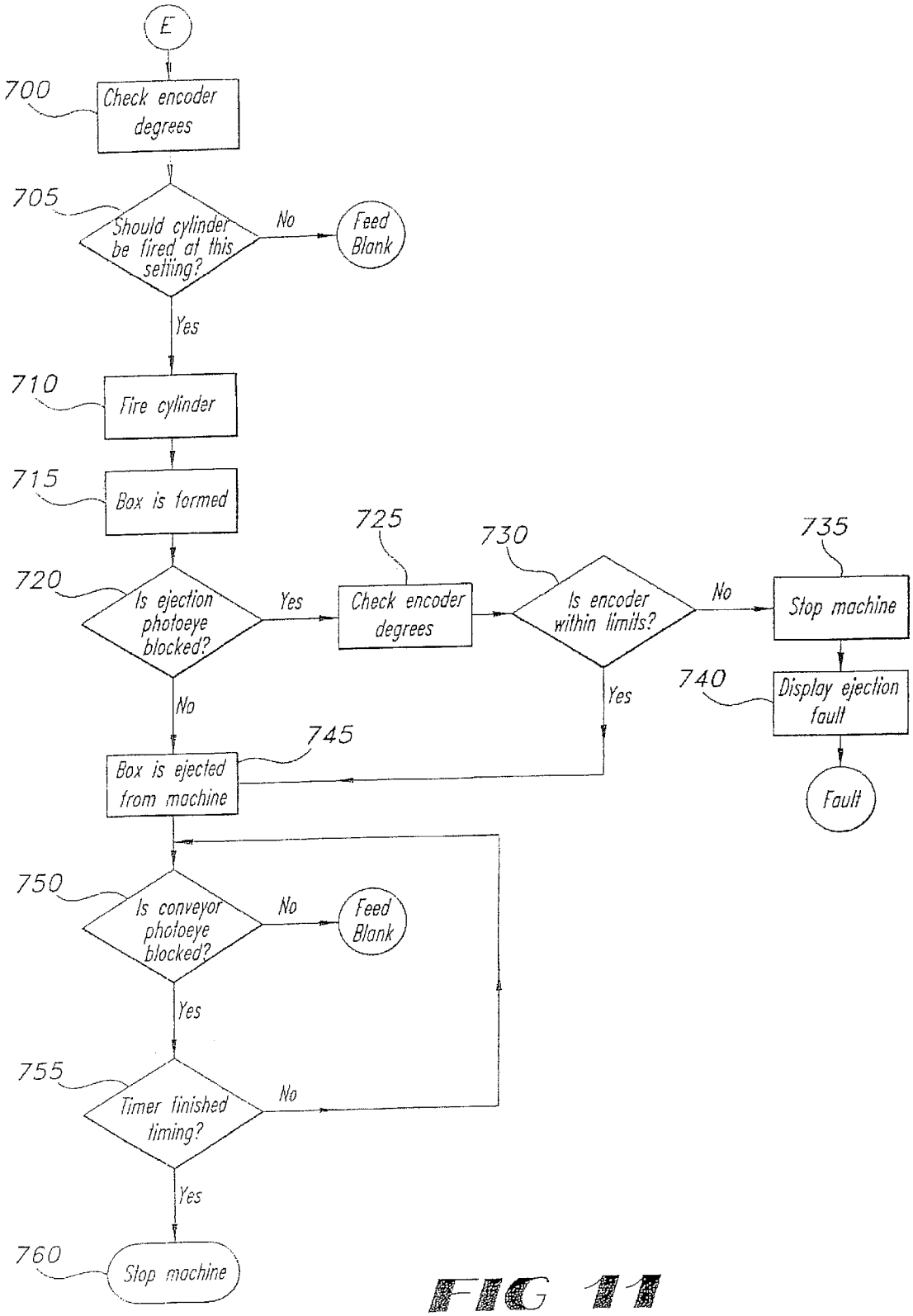

Next, with reference to FIG. 11, the encoder degree is monitored in step 700. In step 705, a determination is made as to whether the air cylinder should be fired at the current encoder degree value, based on programmed information corresponding to a box type and box settings of a box type. If it is determined that the air cylinder should not be fired, then the process continues from step 605. Otherwise, in step 710, a signal is generated to fire the cylinder and in step 715, the box is thereby formed.

Next, in step 720, a signal output by a photoeye associated with the ejection station is monitored. If the signal indicates that the photoeye is blocked indicating that the box is in proper position for ejection, then in step 725, the encoder degrees is checked. If in step 730 the encoder degrees is determined not to be within an activation range corresponding to the programmed parameters, then in step 735, a signal is generated to stop the machine and in step 740, a message or indicator is displayed to indicate an ejection fault. In step 745, which can be reached directly from step 720 or from step 730, a signal is generated to cause the box to be ejected from the machine.

In step 750, a signal from a photoeye positioned to view a particular position of a conveyor is monitored. If the signal from this photoeye indicates that it is blocked, then in step 755, it is determined whether a timer has timed out. If the timer has not timed out, then steps 750 and 755 are repeated. Finally, once the timer has timed out, a signal is generated to stop the machine in step 760.

The foregoing description with reference to FIGS. 8–11 is meant to be an example of the type of control that is performed by the control system according to the present invention. It should be understand that these concepts readily apply to other machine operations as one with ordinary skill in the art would appreciate.

Figure 12:
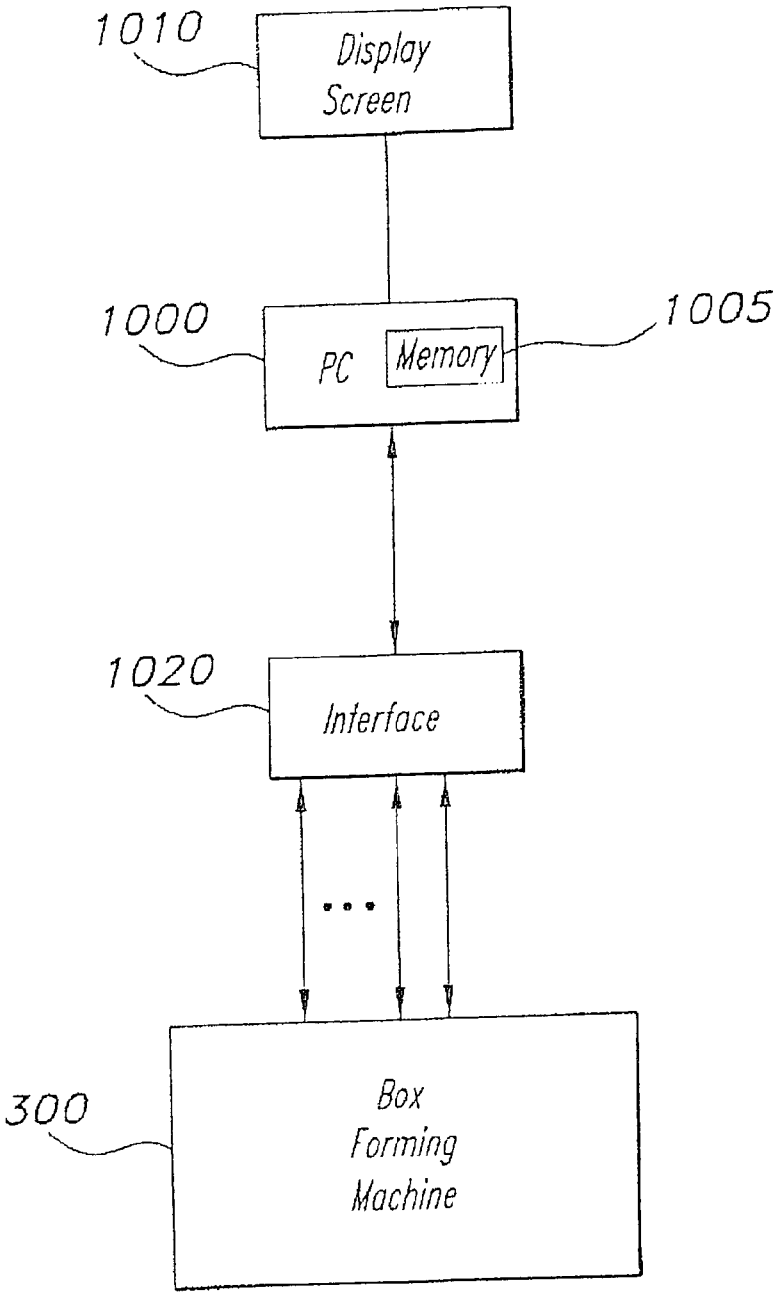
FIG. 12 is a block diagram of a control system for a box forming machine according to another embodiment of the present invention.

Turning to FIG. 12, an alternative embodiment of the control system is shown, featuring a computer (PC) 1000, instead of a PLC 100, as the programmable controller element. The PC 1000 has memory 1005 suitable for storing one or more software programs, including a software program to carry out the process described above in connection with FIGS. 8–11. The PC 1000 is coupled to a display screen 1010 and an interface device 1020. The display screen 1010 is, for example, a touch screen display. The interface device 1020 is a device that interfaces the digital control signals generated by the PC 1000 to the machine elements of the box forming machine. The interface device 1020 includes digital-to-analog and analog-to-digital signal converting capability, and it may be included as board that directly connects to the PC 1000.

As explained above, the PC 1000 is controlled by a software program stored in a processor readable memory medium, such as the memory 1005 that, when executed by the PC 1000, achieves the functions described above in conjunction with FIGS. 8–11.

In other embodiments, the PC 1000 is optionally embodied as a microcontroller, microprocessor, or other processing device.

In summary, the present invention involves a control system for a box forming machine, featuring a controller a controller that is programmable to control the operation of machine elements of the box forming machine; an operator interface coupled to the controller, the operator interface comprising one or more buttons to permit user input; wherein the controller is programmed to: store control information describing a plurality of operational parameters for the plurality of machine elements for each of a plurality of box types; receive a selection from the operator interface to select one of a plurality of box types; monitor signals indicating a position of a box blank as it is moved through the box forming machine; and generate control signals to control the plurality of machine elements based on operational parameters for the selected box type so that the box forming machine forms one or more boxes of the selected box type.

Similarly, the present invention is directed to a method for controlling the operation of a box forming machine, comprising steps of: storing control information describing a plurality of operational parameters for a plurality of machine elements for each of a plurality of box types; receiving a selection from the operator interface to select one of a plurality of box types; monitoring signals indicating a position of a box blank as it is moved through the box forming machine; and generating control signals to control plurality of machine elements based on the operational parameters for the selected box type so that the box forming machine forms one or more boxes of the selected box type.

Further still, the present invention is directed to a software program stored on a aprocessor-readable memory medium including instructions that, when executed by a processor (e.g., a microprocessor, PC, etc.), cause the processor to perform steps of: storing control information describing a plurality of operational parameters for the plurality of machine elements for each of the plurality of box types; receiving a selection from the operator interface to select one of a plurality of box types; monitoring a position of a box blank as it is moved through the box forming machine; and generating control signals to control the plurality of machine elements based on the operational parameters for the selected box type so that the box forming machine forms one or more boxes of the selected box type.

The above description is intended by way of example only and is not intended to limit the present invention except as set forth in the following claims.

What is claimed is:

1. A control system for a box forming machine, comprising:

a controller that is programable to control the operation of a plurality of machine elements of the box forming machine;

an operator interface coupled to the controller, the operator interface comprising one or more buttons to permit user input about a plurality of box types;

wherein the controller is programmed to:

store control information describing a plurality of operational parameters for the plurality of machine elements for each of a plurality of box types;

receive a selection from the operator interface to select one of a plurality of box types;

monitor signals indicating a position of a box blank as it is moved through the box forming machine;

generate control signals to control the plurality of machine elements based on operational parameters for the selected box type so that the box forming machine forms one or more boxes of the selected box type; and receive information throught the operator interface to change or adjust one or more operational parameters for a box type, and to change the stored control information based on a change or adjustment of one or more operational parameters for a box type.

2. The system of claim 1, wherein the box forming machine further comprises an encoder positioned in the box forming machine that generates an output signal which represents a current point in a cycle of operation of the box forming machine, wherein the controller is programmed to store control information describing operational parameters for at least one machine element including information describing an activation range of encoder values within which one or more machine elements should be activated.

3. The system of claim 2, wherein the controller is further programmed to monitor the signal output from the encoder, and the controller generates a control signal for at least one machine element when the signal output from the encoder indicates that the encoder is within an activation range for the at least one machine element based on the stored control information.

4. The system of claim 3, wherein the controller monitors a position of a box blank by monitoring a signal output by a photoeye that is positioned to determine when a box blank has been released from a magazine containing a plurality of box blanks.

5. The system of claim 3, wherein the controller monitors a position of a box blank by monitoring a signal output by a photo eye that is positioned to determine when a blank is in position for folding on a mandrel.

6. The system of claim 5, wherein the controller is programmed to generate a control signal to activate one or more air cylinders in the box forming machine that closes box flaps on the box around the mandrel when the signal output from the encoder is within an activation range determined by the stored control information.

7. The system of claim 3, wherein controller monitors a position of a box blank by monitoring a signal output by a photoeye that is positioned to determine when a box blank is in position to receive glue from the glue gun.

8. The system of claim 7, wherein the controller is programmed to generate a control signal to cause activation of the glue gun when it is determined that a box blank is in position and the signal output from the encoder is within an activation range determined by the stored control information.

9. A method for controlling operation of a box forming machine, comprising steps of:

storing control information describing a plurality of operational parameters for a plurality of machine elements for each of a plurality of box types;

receiving a selection from an operator interface to select one of a plurality of box types;

monitoring signals indicating a position of a box blank as it is moved through the box forming machine;

generating control signals to control plurality of machine elements based on the operational parameters for the selected box type so that the box forming machine forms one or more boxes of the selected box type; and receiving information through an operator interface to change or adjust one or more operational parameters for a box type, and to change the stored control information based on a change or adjustment of one or more operational parameters for a box type.

10. The method of claim 9, wherein the step of storing information describing a plurality of operational parameters comprises storing information describing an activation range of encoder values within which at least one machine element should be activated.

11. The method of claim 10, and further comprising the step of monitoring a signal output from an encoder positioned in the machine that represents a point in a cycle of operation of the machine, wherein the step of generating control signals comprises generating a control signal for at least one of the machine elements when the signal output from the encoder indicates that the encoder is within an activation range for the at least machine element based on the stored control information.

12. The method of claim 11, wherein the step of monitoring a position of a box blank comprises monitoring a signal output by a photoeye that is positioned to determine when a box blank has been released from a magazine containing a plurality of box blanks.

13. The method of claim 11, wherein the step of monitoring a position of a box blank comprises monitoring a signal output by a photoeye that is positioned to determine when a blank is in position for folding on a mandrel.

14. The method of claim 13, wherein the step of generating control signals comprises generating a control signal to activate one or more air cylinders in the box forming machine that closes box flaps on the box around the mandrel when the signal output from the encoder is within a corresponding activation range determined by the stored control information.

15. The method of claim 11, wherein the step of monitoring a position of a box blank comprises monitoring a signal output by a photoeye that is positioned to determine when a box blank is in position to receive glue from the glue gun.

16. The method of claim 15, wherein the step of generating a control signal comprises generating a signal to cause activation of the glue gun when it is determined that a box blank is in position and the signal output from the encoder is within a corresponding activation range determined by the stored control information.

17. A processor-readable memory medium storing instructions that, when executed by a processor, cause the processor to perform the steps of:

storing control information describing a plurality of operational parameters for a plurality of machine elements for each of a plurality of box types;

receiving a selection from an operator interface to select one of a plurality of box types;

monitoring a position of a box blank as it is moved through a box forming machine;

generating control signals to control the plurality of machine elements based on the operational parameters for the selected box type so that the box forming machine forms one or more boxes of the selected type; and receiving information through the operator interface to change or adjust one or more operational paramters for a box type, and to change the stored control information based on a change or adjustment of one or more operational parameters for a box type.

18. The processor-readable memory medium of claim 17, and further storing instructions which, when executed, cause a processor to store control information describing operational parameters for at least one machine element including information describing an activation range of encoder values within which one or more machine elements should be activated.

19. The processor-readable memory medium of claim 18, and further storing instructions which, when executed, cause a processor to monitor a signal output from an encoder in the box forming machine, and cause the processor to generate a control signal for at least one machine element when the signal output from the encoder indicates that the encoder is within an activation range for the at least one machine element based on the stored control information.

20. The processor-readable memory of claim 19, and further storing instructions which, when executed, cause a processor to monitor a signal output by a photoeye that is positioned to determine when a box blank has been released from a magazine containing a plurality of box blanks.

21. The processor-readable memory medium of claim 19, and further storing instructions which, when executed, cause a processor to monitor a position of a box blank by monitoring a signal output by a photoeye that is positioned to determine when a blank is in position for folding on a mandrel.

22. The processor-readable memory medium of claim 21, and further storing instructions which, when executed, cause a processor to generate a control signal to activate one or more air cylinders in the box forming machine that closes box flaps on the box around the mandrel when the signal output from the encoder is within an activation range determined by the stored control information.

23. The processor-readable memory medium of claim 19, and further storing instructions which, when executed, cause a processor to monitor a position of a box blank by monitoring a signal output by a photoeye that is positioned to determine when a box blank is in position to receive glue from the glue gun.

24. The processor-readable memory medium of claim 23, and further storing instructions which, when executed, cause a processor to generate a control signal to cause activation of the glue gun when it is determined that a box blank is in position and the signal output from the encoder is within an activation range determined by the stored control information.

25. A control system for a box forming machine, comprising:

a controller that is programmable to control operation of a plurality of machine elements of the box forming machine;

an operator interface coupled to the controller, the operator interface comprising one or more buttons to permit user input about a plurality of box types;

an encoder positioned in the box forming machine that generates an output signal which represents a current point in a cycle of operation of the box forming machine;

wherein the controller is programmed to:

store control information describing a plurality of operational parameters for the plurality of machine elements for each of a plurality of box types, including information describing an activation range of encoder values within which one or more machine elements should be activated;

receive a selection from the operator interface to select one of a plurality of box types;

monitor signals indicating a position of a box blank as it is moved through the box forming machine including monitoring the output signal of the encoder;

generate control signals to control the plurality of machine elements based on operational parameters for the selected box type including a control signal for at least one machine element when the signal output from the encoder indicates that the encoder is within an activation range for the at least one machine element based on the stored control information so that the box forming machine forms one or more boxes of the selected box type.

26. The system of claim 25, wherein the controller monitors a position of a box blank by monitoring a signal output by a photoeye that is positioned to determine when a box blank has been released from a magazine containing a plurality of box blanks.

27. The system of claim 25, wherein the controller monitors a position of a box blank by monitoring a signal output by a photoeye that is positioned to determine when a blank is in position for folding on a mandrel.

28. The system of claim 27, wherein the controller is programmed to generate a control signal to activate one or more air cylinders in the box forming machine that closes box flaps on the box around the mandrel when the signal output from the encoder is within an activation range determined by the stored control information.

29. The system of claim 25, wherein controller monitors a position of a box blank by monitoring a signal output by a photoeye that is positioned to determine when a box blank is in position to receive glue from the glue gun.

30. The system of claim 29, wherein the controller is programmed to generate a control signal to cause activation of the glue gun when it is determined that a box blank is in position and the signal output from the encoder is within an activation range determined by the stored control information.

31. The system of claim 25, wherein the controller is programed to receive information through the operator interface to change or adjust one or more operational parameters for a box type, and to change the stored control information based on a change or adjustment of one or more operational parameters for a box type.

32. A method for controlling operation of a box forming machine, comprising steps of:

storing control information describing a plurality of operational parameters for a plurality of machine elements for each of a plurality of box types including information describing an activation range of encoder values of an encoder within which at least one machine element should be activated;

receiving a selection from an operator interface to select one of a plurality of box types;

monitoring signals indicating a position of a box blank as it is moved through the box forming machine including monitoring a signal output by the encoder that represents a connect point in a cycle of operation of a box forming machine; and generating control signals to control a plurality of machine elements based on the operational parameters for the selected box type including a control signal for at least one of the machine elements when the signal oputput from the encoder indicates that the encoder is within an activation range for the at least machine element based on the stored control information so that the box forming machine forms one or more boxes of the selected box type.

33. The method of claim 32, wherein the step of monitoring a position of a box blank comprises monitoring a signal output by a photoeye that is positioned to determine when a box blank has been released from a magazine containing a plurality of box blanks.

34. The method of claim 32, wherein the step of monitoring a position of a box blank comprises monitoring a signal output by a photoeye that is positioned to determine when a blank is in position for folding on a mandrel.

35. The method of claim 34, wherein the step of generating control signals comprises generating a control signal to activate one or more air cylinders in the box forming machine that closes box flaps on the box around the mandrel when the signal output from the encoder is within a corresponding activation range determined by the stored control information.

36. The method of claim 32, wherein the step of monitoring a position of a box blank comprises monitoring a signal output by a photoeye that is positioned to determine when a box blank is in position to receive glue from the glue gun.

37. The method of claim 36, wherein the step of generating a control signal comprises generating a signal to cause activation of the glue gun when it is determined that a box blank is in position and the signal output from the encoder is within a corresponding activation range determined by the stored control information.

38. The method of claim 32, and further comprising the step of receiving information through an operator interface to change or adjust one or more operational parameters for a box type, and to change the stored control information based on a change or adjustment of one or more operational parameters for a box type.

39. A processor-readable memory medium storing instructions that, when executed by a processor, cause the processor to perform the steps of:

storing control information describing a plurality of operational parameters for a plurality of machine elements for each of a plurality of box types including information describing an activation range of values of an encoder, within which one or more machine elements should be activated;

receiving a selection from an operator interface to select one of a plurality of box types;

monitoring a position of a box blank as it is moved through the box forming machine including a signal output from the encoder in the box forming machine; and generating control signals to control the plurality of machine elements based on the operational parameters for the selected box type so that the box forming machine forms one or more boxes of the selected box type including a control signal for at least one machine element when the signal output from the encoder indicates that the encoder is within an activation range for the at least one machine element based on the stored control information.

40. The processor-readable memory medium of claim 39, and further storing instructions which, when executed, cause a processor to monitor a signal output by a photoeye that is positioned to determine when a box blank has been released from a magazine containing a plurality of box blanks.

41. The processor-readable memory medium of claim 39, and further storing instructions which, when executed, cause a processor to monitor a position of a box blank by monitoring a signal output by a photoeye that is positioned to determine when a blank is in position for folding on a mandrel.

42. The processor-readable memory medium of claim 41, and further storing instructions which, when executed, cause a processor to generate a control signal to activate one or more air cylinders in the box forming machine that closes box flaps on the box around the mandrel when the signal output from the encoder is within an activation range determined by the stored control information.

43. The processor-readable memory medium of claim 39, and further storing instructions which, when executed, cause a processor to monitor a position of a box blank by monitoring a signal output by a photoeye that is positioned to determine when a box blank is in position to receive glue from the glue gun.

44. The processor-readable memory medium of claim 43, and further storing instructions which, when executed, cause a processor to generate a control signal to cause activation of the glue gun when it is determined that a box blank is in position and the signal output from the encoder is within an activation range determined by the stored control information.

45. The processor-readable memory medium of claim 44, and further storing instructions which, when executed, cause a processor to receive information through the operator interface to change or adjust one or more operational parameters for a box type, and to change the stored control information based on a change or adjustment of one or more operational parameters for a box type.

* * * * *